United States Patent [19]

Blanchard

[11] 4,311,470

[45] Jan. 19, 1982

[54] TROLLING MOTOR

[75] Inventor: Clarence E. Blanchard, Kenosha, Wis.

[73] Assignee: Outboard Marine Corporation, Waukegan, Ill.

[21] Appl. No.: 128,961

[22] Filed: Mar. 10, 1980

[51] Int. Cl.[3] ..... B63H 5/13

[52] U.S. Cl. ..... 440/6; 440/900

[58] Field of Search ..... 440/6, 900; 290/43, 290/54; 74/421 A, 421 R; 310/87

[56] References Cited

U.S. PATENT DOCUMENTS 3,364,772 1/1968 Easton ..... 74/421 A 4,092,946 6/1978 Kappas ..... 440/6

*Primary Examiner*—Frank Sever

*Attorney, Agent, or Firm*—Michael, Best & Friedrich

[57] ABSTRACT

The invention provides an outboard motor including a shaft extending vertically under normal operating conditions and having a lower end, the shaft being supported by a boat hull. An electric motor is fixedly connected to the lower end of the vertical shaft and includes an output shaft. The output shaft is drivingly connected by a counter shaft gearing arrangement to a propeller shaft so as to drive a propeller supported thereon at a rotational speed less than the rotational speed of the output shaft of the electric motor. The counter shaft gearing arrangement includes a first drive gear driven by the electric motor output shaft, and a first driven gear driven by the first drive gear. A second drive gear is fixed to the first driven gear for rotation with the first driven gear about a counter shaft, and a second driven gear is carried by the propeller shaft and drives the propeller shaft, the second driven gear being in enmeshing engagement with the second drive gear and being driven by the second drive gear.

3 Claims, 3 Drawing Figures

TROLLING MOTOR

FIELD OF THE INVENTION

The invention relates to outboard motors and more particularly to speed reduction gearing employed in electrically driven outboard motors.

BACKGROUND PRIOR ART

Examples of electrically driven outboard motors are shown in the Blake U.S. Pat. No. 3,954,081, issued May 4, 1976; the Blake et al. U.S. Pat. No. 4,075,970, issued Feb. 28, 1978; and the Beem U.S. patent application Ser. No. 079,488, filed Sept. 27, 1979 and assigned to the assignee of the present invention.

Attention is also directed to the Alexander, Jr. U.S. Pat. No. 4,099,478, issued July 11, 1978 and illustrating a trolling motor employing a planetary gear assembly to provide speed reduction between the output shaft of the electric motor and the propeller shaft. A similar trolling motor is shown in the Croissant U.S. Pat. No. 4,009,677, issued Mar. 1, 1977.

Another trolling motor of the type employing a planetary gear system to provide speed reduction between the output shaft of the electric motor and the propeller is shown in the Kappas U.S. Pat. No. 4,092,946, issued June 6, 1978.

Attention is further directed to the Childre U.S. Pat. No. 3,995,579, issued Dec. 7, 1976; the Kappas U.S. Pat. No. 3,906,877, issued Sept. 23, 1975; and the Balaguer U.S. Pat. No. 3,703,642, issued Nov. 21, 1972.

Attention is also directed to the Cramer U.S. Pat. No. 3,797,448, issued Mar. 19, 1974; the Cramer U.S. Pat. No. 3,723,839, issued Mar. 27, 1973; the Baldwin U.S. Pat. No. 3,628,492, issued Dec. 21, 1971; and the Wood Jr. U.S. Pat. No. 3,498,253, issued Mar. 3, 1970.

Attention is also directed to the Harris U.S. Pat. No. 2,824,984; issued Feb. 25, 1958; and the Fischer et al. U.S. Pat. No. 2,749,776, issued June 12, 1956.

SUMMARY OF THE INVENTION

The present invention provides an outboard motor such as a trolling motor which includes an improved means for providing speed reduction between the output shaft of the motor and the propeller.

More particularly, the invention provides an outboard motor including a shaft extending vertically under normal operating conditions and having a lower end, means connected to the shaft for mounting the shaft to a boat hull, and an electric motor fixedly connected to the lower end shaft and including an output shaft. The outboard motor also includes a propeller shaft, and a propeller rotatably supported by the propeller shaft. The outboard motor further includes means for drivingly connecting the output shaft and the propeller shaft and for driving the propeller at a rotational speed less than the rotational speed of the output shaft. The connecting means includes a first drive gear driven by the output shaft, a first driven gear in enmeshing engagement with the first drive gear and driven by the first drive gear, a second drive gear fixed to the first drive gear for rotation with the first drive gear about a common axis, and a second driven gear carried by the propeller shaft and driving the propeller shaft, the second driven gear being in enmeshing engagement with the second drive gear and being driven by the second drive gear.

The invention further provides an outboard motor having a shaft extending vertically under normal operating conditions, means connected to the shaft for mounting the shaft to a boat hull, a lower housing fixedly connected to the shaft and including a hollow interior, and an electric motor mounted in the lower housing and including an output shaft. The outboard motor also includes a propeller shaft, and a propeller rotatably supported by the propeller shaft. The outboard motor further includes means for drivingly connecting the output shaft and the propeller shaft and for driving the propeller at a rotational speed less than the rotational speed of the output shaft. The connecting means includes a first drive gear driven by the output shaft, and an intermediate gear including a first gear portion in enmeshing relation with the first drive gear and driven by the first drive gear and a second gear portion integrally joined to the first gear portion and coaxial with the first gear portion, the second gear portion having a circumference smaller than the first gear portion. The connecting means also includes a counter shaft supported by the housing and supporting the intermediate gear for rotation about an axis generally parallel to the drive shaft, and a driven gear in enmeshing engagement with the second gear portion and being driven by the second gear portion, the driven gear being carried by the propeller shaft and driving the propeller shaft.

Other features of the invention are set forth in the following description, in the drawings, and in the claims.

Figure 1:
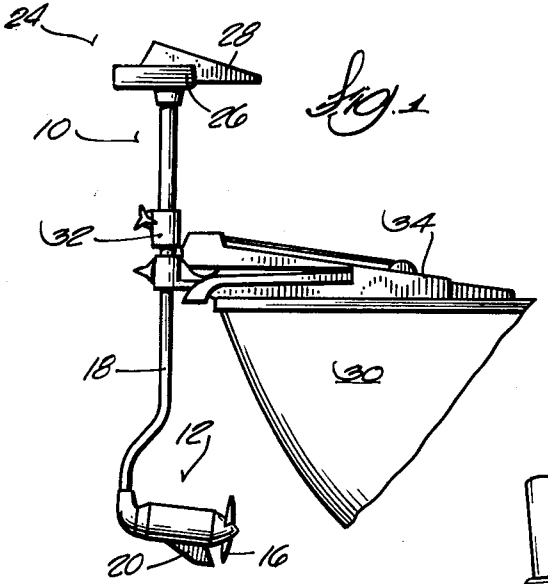
FIG. 1 is a side elevation view of an outboard motor embodying various features of the invention.

Before explaining at least one embodiment of the invention in detail, it is to be understood that the invention is not limited in its application to the details of construction and the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in the drawings is an outboard motor 10 including a lower unit 12 housing an electric motor 14 (FIG. 2) for driving a propeller 16. The lower unit 12 is mounted on the lower end of an elongated motor tube or shaft 18 which carries suitable wiring connecting the electric motor 14 of the lower unit 12 to the boat battery (not shown). Depending from the lower unit 12 is a skeg 20.

The outboard motor 10 also has an upper unit 24 which is connected to the upper end of the motor tube 18 and includes a housing 26 including means for controlling the power supplied to the electric motor 14 and a handle 28 fixedly joined to the tube 18 for permitting manual rotation of the housing 26 and the tube 18 about the axis of the steering tube to thereby effect steering movement of the lower unit 12.

Means are also provided for mounting the outboard motor 10 on a boat hull 30. While in the illustrated construction the mounting means is shown as attaching the motor 10 to the bow of the boat, the motor can also be supported in other conventional ways. In the illustrated construction the means for mounting the outboard motor 10 includes a support bracket 32 surrounding the tube and frictionally engaging the tube. The support bracket 32 engages the tube 18 in such a manner that there is sufficient frictional resistance between the tube 18 and the support bracket 32 that force is required to cause rotation of the tube 18 with respect to the support bracket 32. The mounting means also includes a mounting bracket 34 fixedly attached to the boat hull and supporting the support bracket 32.

Figure 2:
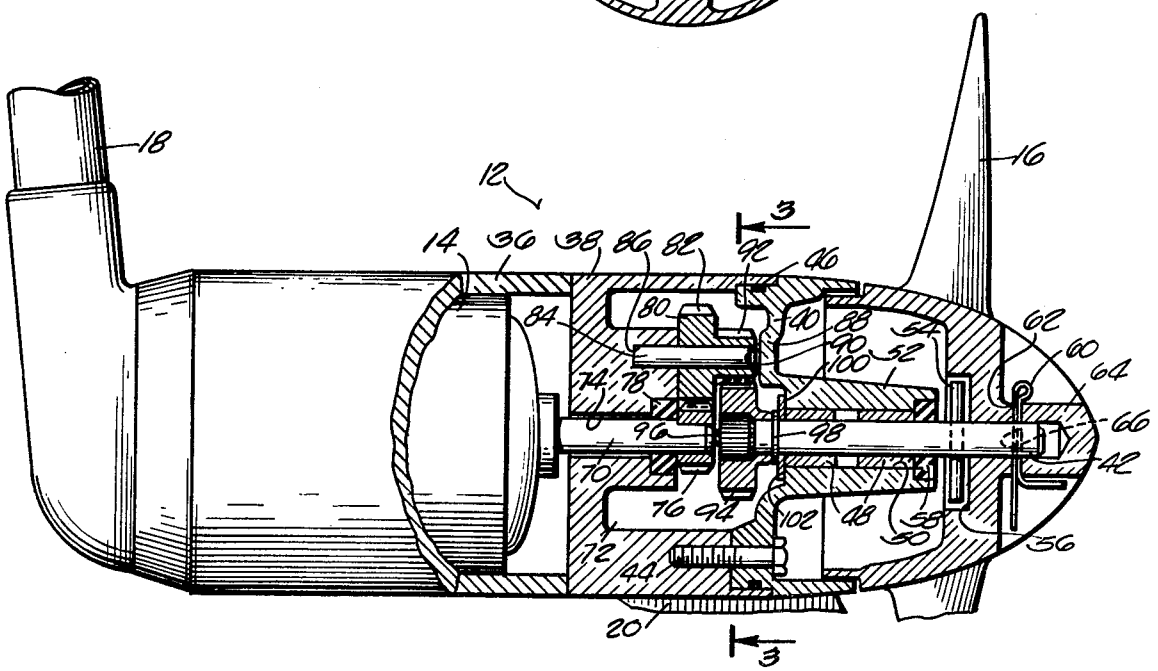
FIG. 2 is an enlarged fragmentary view, partially broken away and partially in section of the outboard shown in FIG. 1.

Referring more specifically to the lower unit 12 and the embodiment of the invention illustrated in FIG. 2, the lower unit 12 includes a housing 36 providing a water tight enclosure for the electric motor 14. The housing 36 includes a main portion and an end cap portion 38 which can be suitably connected to the main portion, as by bolts or otherwise, and which supports a bearing housing or portion 40. In turn, the bearing housing 40 is adapted to rotatably support a propeller shaft 42 and the propeller 16. The bearing housing 40 is secured to the end cap 38 by a plurality of axially extending bolts 44. A fluid tight seal is provided between the bearing housing 40 and the end cap 38 by a rubber seal 46. In other embodiments of the invention, the housing 36 of the lower unit 12 and the electric motor 14 can be integrally joined, and the end cap 38 can be a unitary part of the electric motor 14.

The propeller shaft 42 is rotatably supported by a pair of bearings 48 housed in a longitudinal bore 50 in a central portion 52 of the bearing housing 40, and includes a projecting end supporting the propeller 16. The propeller 16 is drivingly connected to the propeller shaft 42 by a drive pin 54 extending through a transverse bore in the propeller shaft. The drive pin 54 has opposite ends housed in a slot 56 in the propeller 16 and is adapted to drive the propeller in response to rotation of the propeller shaft 42. A seal 58 is located in the longitudinal bore 50 and surrounds the propeller shaft 42 to prevent fluid flow into the longitudinal bore 50.

Means are also provided for retaining the propeller 16 on the propeller shaft 42. While various means can be provided, in the illustrated construction, the propeller retaining means comprises a cotter pin 60 extending through bores 62 in portions 64 of the propeller and through a bore 66 in the end of the propeller shaft.

Means are further provided for drivingly connecting the output shaft 70 of the electric motor 14 to the propeller 16 and for driving the propeller at a rotational speed less than the rotational speed of the output shaft 70. As illustrated in FIG. 2, such means for drivingly connecting the output shaft 70 of the electric motor 14 and the propeller shaft 42 includes a counter-shaft gearing speed reduction arrangement housed within a chamber or cavity 72 defined by the end cap 38 and the bearing housing 40. The output shaft 70 extends through a longitudinally extending bore 74 in the end cap and includes an end extending into the cavity 72, that end of the output shaft 70 carrying a pinion gear 76. A seal 78 surrounds the output shaft and is intended to prevent fluid flow between the cavity 72 and the electric motor housing. The pinion or drive gear 76 meshes with a large diameter gear member 80 of a compound gear 82. The compound gear 82 is supported by a counter shaft 84 which has an end fixedly housed in a bore 86 in the end cap 38 and an opposite end supporting the compound gear 82 for free rotation thereon. While the counter shaft 84 is shown in the illustrated construction as being supported by the end cap 38, in alternative constructions it could be supported by the bearing housing 40 or by both the end cap 38 and the bearing housing 40.

Means are also provided for restricting longitudinal movement of the compound gear 82 on the counter shaft, this restricting means comprising a pad-like boss 88 of the bearing housing 40, the pad-like boss 88 including a planar face 90 closely adjacent but spaced from the compound gear 82.

The compound gear 82 also includes a small diameter portion 92 meshing with a driven gear 94 carried in splined relation on the end of the propeller shaft 42.

In the illustrated construction, the pinion gear or drive gear 76 has fewer teeth than the large diameter portion or driven gear portion 80 of the compound gear 82, and the small diameter portion or drive gear portion 92 of the compound gear 82 has fewer teeth than the driven gear 94. Accordingly, the propeller shaft 42 is driven at a slower speed than the output shaft 70 of the electric motor 14.

While the counter-shaft gearing arrangement has been described as including one compound gear 82, it will be understood by those skilled in the art that the number of compound gears 82 employed could vary from one to six or more depending on the forces to be transmitted through the gears. By providing a plurality of compound gears 82, the forces transmitted from the output shaft 70 to the propeller shaft 42 would be divided by the number of compound gears 82 employed. Use of a greater number of compound gears 82 thus facilitates transmission of greater forces to the propeller shaft 42 with less force being applied to the individual compound gears.

Means are further provided for transmitting the axial thrust of the rotating propeller 16 through the propeller shaft 42 and directly to the motor output shaft 70 whereby that axial thrust can be transmitted to the lower unit housing 36 by the thrust bearings of the electric motor. This means comprises a convex or rounded thrust transmitting end portion 96 of the propeller shaft 42 which abuts or engages the end of the electric motor output shaft 70. Axial thrust from the propeller 16 is transmitted to the propeller shaft 42 and then from the rounded end 96 of the propeller shaft 42 to the output shaft 70 of the electric motor 14. The axial thrust on the output shaft 70 of the electric motor is transmitted by thrust bearings (not shown) of the electric motor to the lower unit housing 36. One of the advantages of the countershaft gear reduction arrangement described above is that axial thrust from the propeller shaft can be transmitted directly to the output shaft 70 of the electric motor 14, and the employment of thrust bearings for supporting the compound gear 82 and the propeller shaft 42 can be avoided.

Means are also provided for transmitting reverse axial thrust from the propeller 16 to the housing 36 of the lower unit 12. In the illustrated construction, such means comprises a snap ring 98 housed in an annular groove surrounding the propeller shaft and a thrust washer 100 surrounding the propeller shaft 42 and held between the snap ring 98 and the face 102 of the bearing housing 40. When the propeller 16 exerts reverse thrust on the propeller shaft 42, the snap ring 98 is forced against the thrust waster 100 thereby transmitting that force to the bearing housing 40 and to the lower unit 12.

Figure 3:
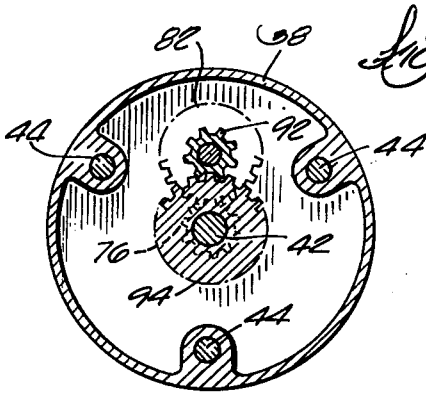
FIG. 3 is a cross-section view taken along line 3—3 in FIG. 2.

Another of the advantages of the invention is that the countershaft gear reduction arrangement provides a means for effecting a speed reduction of the output of the electric motor 14 which has a less complicated structural arrangement than prior art structures, such simplification of the gear reduction structure facilitating lower manufacturing costs than other types of speed reduction arrangements. For example, the gear reduction arrangement illustrated in FIGS. 2 and 3 is substantially less costly than construction and assembly of a planetary gear reduction system. The construction illustrated in FIGS. 2 and 3 can be accomplished by mounting the gear 76 on the output shaft 70 of the electric motor 14 and the gear 94 on the propeller shaft 42. The countershaft 84 is then secured in bore 86 in the end cap 38, and the compound gear 82 can be placed on the countershaft 84. The bearing housing 40 can then be bolted onto the end cap 38 to complete the assembly of the countershaft speed reduction arrangement. It will be appreciated by one skilled in the art that construction and assembly of a planetary gear system will be more complicated and costly than that described above. Additionally, the means for providing transfer of axial thrust from the propeller can be less complicated than that required when a planetary gear system is employed as a speed reduction means.

Various features of the invention are set forth in the following claims.

I claim:

1. An outboard motor comprising a shaft extending vertically in a normal operating condition and having a lower end, means connected to said shaft for mounting said shaft to a boat, a lower housing fixedly connected to said lower end of said shaft and including a first housing portion having a hollow interior and a second housing portion detachably fixedly connected to said first housing portion and defining therebetween a gear cavity, an electric motor mounted in said hollow interior of said first housing portion and including an output shaft extending into said gear cavity, a propeller shaft rotatably mounted in said second housing portion in co-axial relation to said output shaft and extending into said gear cavity, a propeller carried by said propeller shaft, means within said gear cavity for drivingly connecting said output shaft and said propeller shaft so as to rotate said propeller shaft at a speed less than the speed of said output shaft and so as to facilitate economy of manufacture, said connecting means including a drive gear fixed on said output shaft, a countershaft fixedly supported in parallel relation to said output shaft and against rotation by one of said housing portions and having an outer end positioned closedly adjacent to and unsupported by the other of said housing portions, a compound intermediate gear rotatably mounted on said countershaft and including a first gear portion meshed with said drive gear in driving relation thereto, and a second gear portion integrally joined to said first gear portion in coaxial relation thereto, and a driven gear fixed on said propeller shaft and meshed with said second gear portion in driving relation thereto, and means for restraining said compound intermediate gear against axial movement on said countershaft and including a surface portion formed on said other of said housing portions and located adjacent to said compound intermediate gear.

2. An outboard motor in accordance with claim 1 wherein said propeller shaft axially engages said output shaft for transmission of forward thrust from said propeller shaft through said output shaft and to said first housing portion.

3. An outboard motor in accordance with claim 1 wherein said propeller shaft includes a bearing surface located between said driven gear and said second housing portion for engagement with said second housing portion to transmit reverse thrust from said propeller shaft to said second housing portion.

* * * * *